US007024734B2

(12) United States Patent
Anscher

(10) Patent No.: US 7,024,734 B2
(45) Date of Patent: Apr. 11, 2006

(54) BUCKLE WITH SCREEN COVER

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 10/713,311

(22) Filed: Nov. 14, 2003

(65) Prior Publication Data

US 2005/0102805 A1 May 19, 2005

(51) Int. Cl.
*A44B 11/25* (2006.01)

(52) U.S. Cl. ..... 24/625; 24/615; 24/604; 24/591.1

(58) Field of Classification Search ..... 24/615, 24/163 K, 625, 614, 616, 651, 591.1, 629, 24/662, 666–667, 604; 340/573.1; 200/51.09
See application file for complete search history.

(56) References Cited

U.S. PATENT DOCUMENTS 3,797,693 A * 3/1974 Baker ..... 220/370
4,264,899 A * 4/1981 Menzies et al. ..... 340/546
4,534,090 A * 8/1985 Skobel ..... 24/625
4,928,364 A * 5/1990 Ikeda ..... 24/614
5,383,257 A * 1/1995 Krauss ..... 24/625
5,541,579 A * 7/1996 Kiernan ..... 340/573.1
5,794,316 A * 8/1998 Anscher ..... 24/625
5,926,928 A * 7/1999 Lundstedt ..... 24/625
6,130,084 A * 10/2000 Endencia et al. ..... 435/305.1
6,754,938 B1 * 6/2004 Savoulidou ..... 24/616

* cited by examiner

*Primary Examiner*—Jack W. Lavinder
(74) *Attorney, Agent, or Firm*—Collard & Roe, P.C.

(57) ABSTRACT

A buckle comprises a male portion and a female portion, the female portion having a top face, a bottom face and a cavity for accepting the male portion. The male portion is adapted to snap into the female portion to lock the two portions of the buckle together. At least one face of the female portion is formed from an integrally molded screen made of the same material as the rest of the female portion and having a thickness that is less than a thickness of the female portion. The screen reduces the weight of the buckle, making it more comfortable for the user as well as less expensive to manufacture.

7 Claims, 3 Drawing Sheets

BUCKLE WITH SCREEN COVER

BACKGROUND OF THE INVENTION

1. Field of the Invention

This invention relates to a buckle having a portion integrally formed of a screen, to decrease the weight of the buckle without decreasing its strength and durability.

2. The Prior Art

It is often a goal in the manufacture of buckles to decrease the weight of the buckle without compromising its strength. One such buckle is shown in U.S. Pat. No. 5,926,928 to Lundstedt, which shows a typical side-release type buckle having a plurality of vents on both the upper and lower faces of the female component of the buckle. The vents both reduce the weight and allow air flow through the buckle.

A disadvantage of this type of buckle, however, is that the vents compromise the integrity of the buckle, and reduce its strength and durability. Repeated tension on the female portion makes this portion more susceptible to failure due to the vents.

SUMMARY OF THE INVENTION

It is therefore an object of the invention to provide a buckle that is reduced in weight and yet does not have any reduction in strength and durability from similar type buckles.

It is another object of the invention to provide such a buckle that is simple and inexpensive to manufacture, as well as attractive in appearance.

These and other objects are achieved with a buckle according to the invention, which comprises a male portion and a female portion, the female portion having a top face, a bottom face and a cavity for accepting the male portion. The male portion is adapted to snap into the female portion to lock the two portions of the buckle together. At least one face of the female portion is formed from a screen made of the same material as the rest of the female portion and having a thickness that is less than a thickness of the female portion. The screen is made from a plurality of crossed bars, defining a set of substantially uniformly spaced holes between the bars.

In a preferred embodiment, there is a rib disposed along an underside at least one of the faces. The rib extends across the screen to support the portion of the buckle containing the screen. Most preferably, there are two ribs disposed on an underside of each of the top and bottom faces, said ribs facing each other and extending in a longitudinal direction, and acting as a guide for the male portion when the male portion is inserted into the female portion.

The screen is preferably surrounded by an additional rib having a thickness greater than the thickness of the face containing the screen. This adds additional strength to the buckle without measurably increasing its weight.

There is preferably at least one strap attachment bar connected to at least one of the male portion and female portion, to connect the buckle to a strap.

In a preferred embodiment, the buckle is a side-release type buckle, with the male portion having two release tabs that snap into two locking slots on the female portion to lock the male portion to the female portion, and wherein pressing the release tabs causes the male portion to be ejected from the female portion. However, other types of buckles, such as center-push buckles could also be used.

By having a screen in the female portion, the weight of the buckle can be decreased by as much as 15–20%. This increases user comfort while decreasing the manufacturing cost, because less plastic is required.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
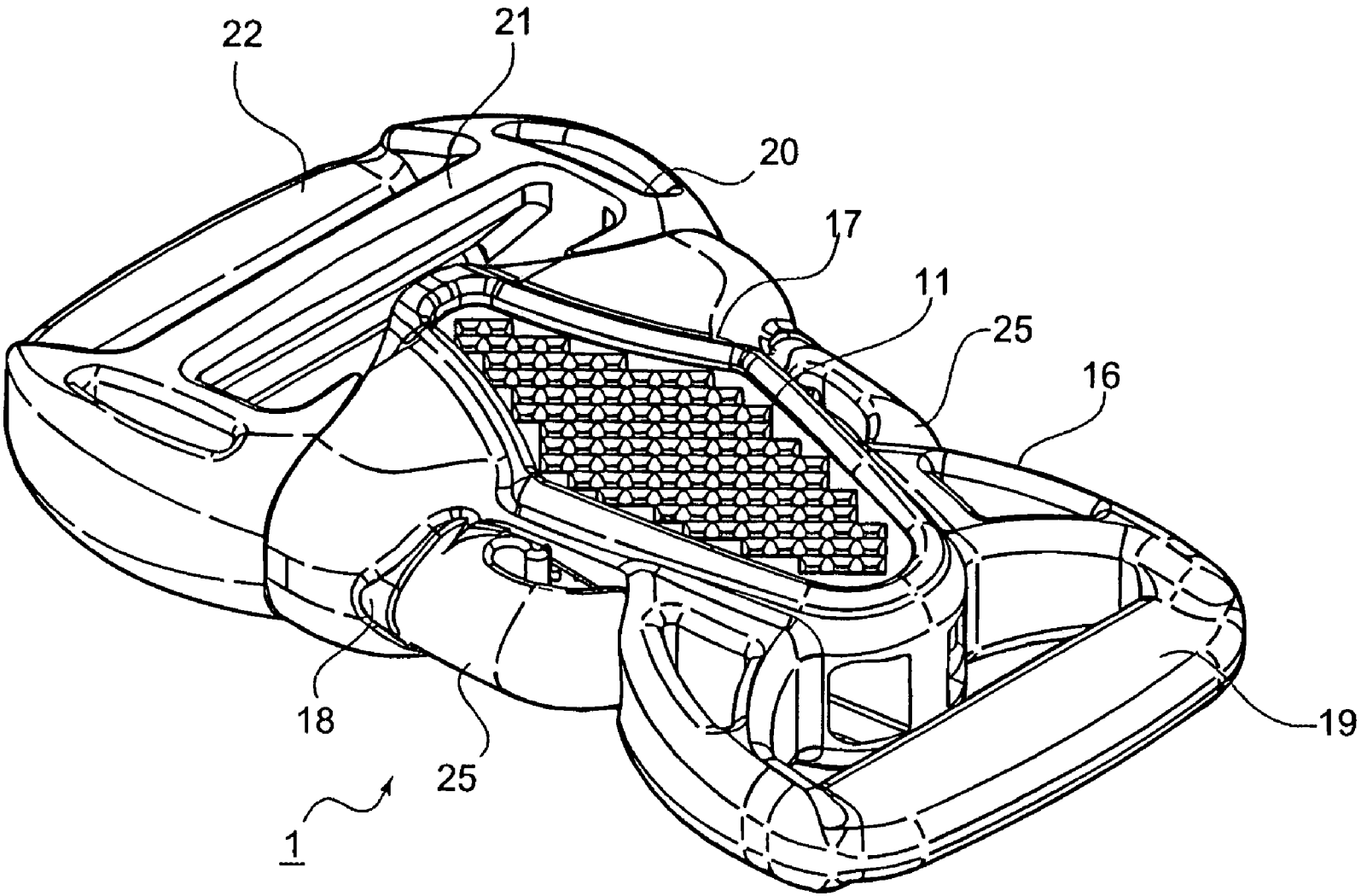
FIG. 1 shows a perspective view of the buckle in a locked condition.
Figure 2:
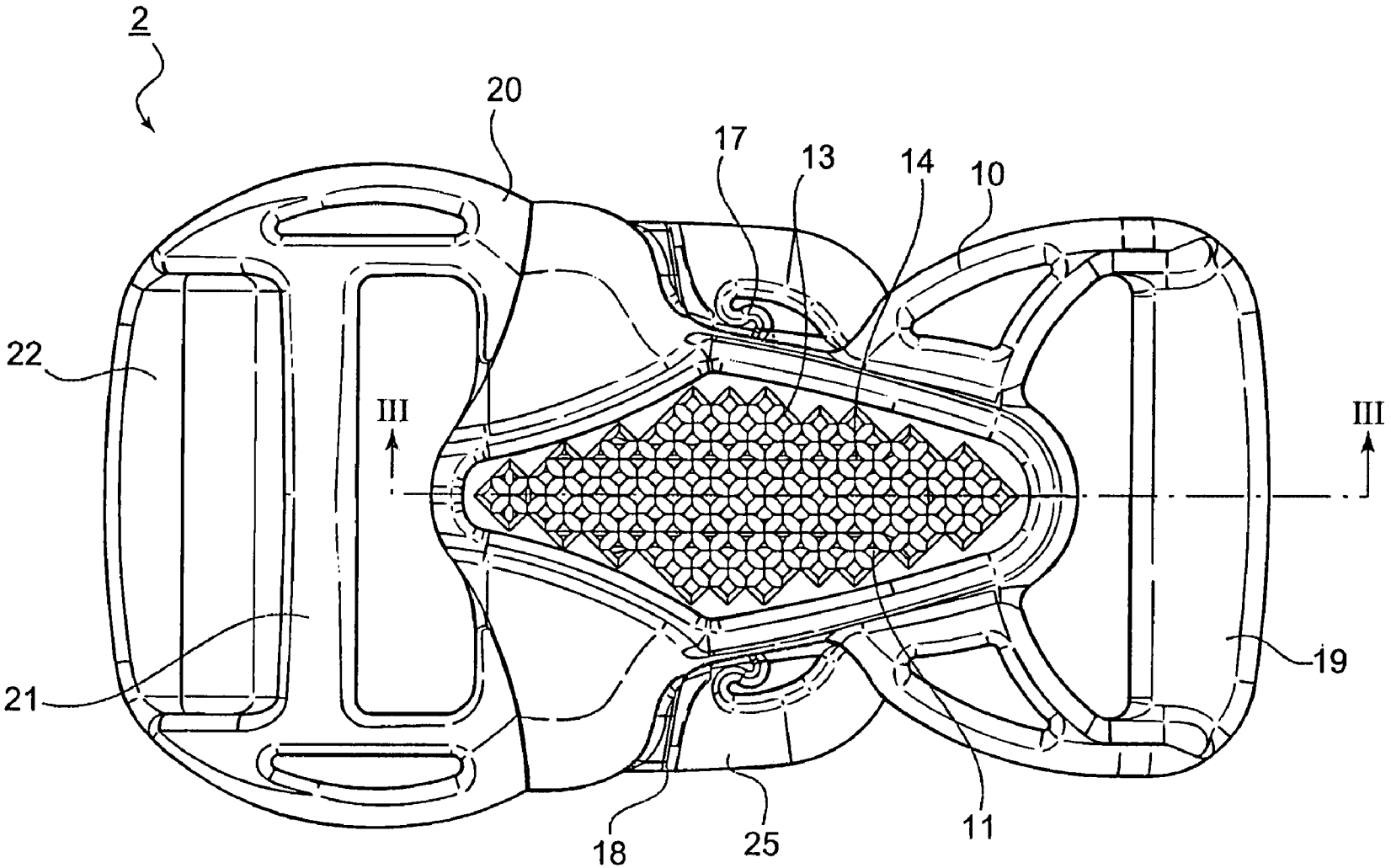
FIG. 2 shows a top view of the buckle of FIG. 1.

Referring now in detail to the drawings and, in particular, FIGS. 1 and 2 show a preferred embodiment of the buckle 1 according to the invention. Buckle 1 comprises a female portion 10 and a male portion 20. Male portion 20 snaps into an inner cavity in female portion 20 to lock the two portions together.

Figure 3:
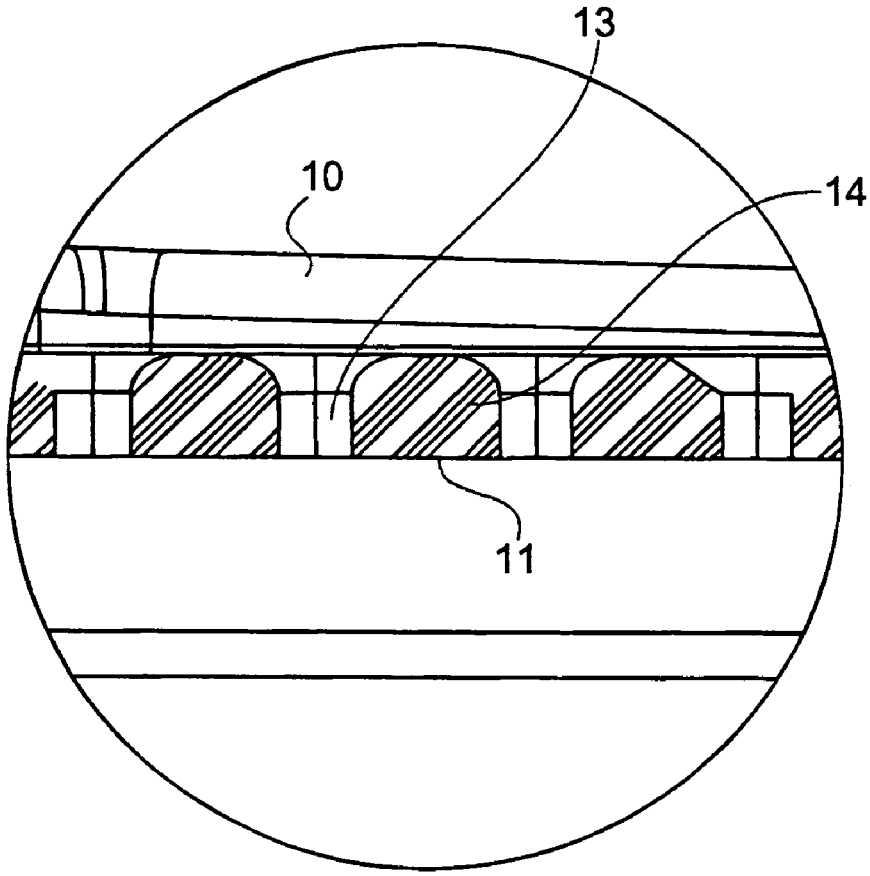
FIG. 3 shows a side cross sectional view of the female portion of the buckle along lines III—III of FIG. 2.
Figure 4:
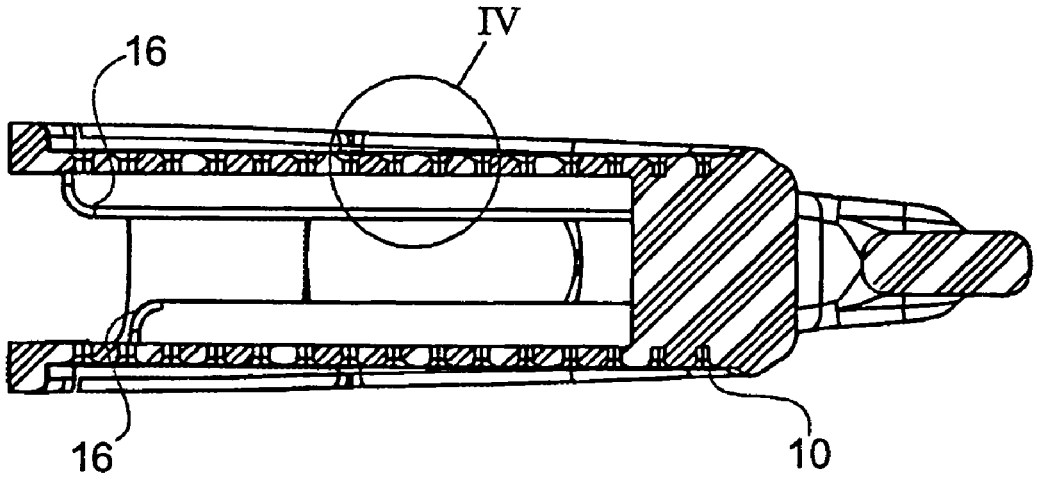
FIG. 4 shows an enlarged detail IV from FIG. 3.

The top and bottom surfaces of female portion 10 have a section of screen 11. As shown in FIGS. 3 and 4, screen 11 has a thickness substantially less than the thickness of female portion 10. In a preferred embodiment, buckle 1 is approximately 15–20% lighter in weight than an identical buckle without the screen.

Screen 11 is formed from a plurality of cross-hatched bars 13, with a plurality of evenly-spaced apertures 14 in between. There is a rib disposed along an underside of at least one face, the rib extending across the screen to support the portion of the buckle containing the screen.

As shown in FIG. 3, there are two ribs 16 disposed on an underside of each of the top and bottom faces. The ribs facing each other and extend in a longitudinal direction, and act as a guide for the male portion 20 when male portion 20 is inserted into female portion 10. Ribs 16 also lend additional support to screen 11 to increase the strength and durability of buckle 1 without significantly adding to its weight.

There is a rib 17 surrounding screen 11. Rib 17 has a thickness greater than the thickness of screen 11 and lends additional support to screen 11 so that buckle 1 has sufficient strength and durability. Female portion 10 is integrally molded in one piece, preferably from a rigid, durable plastic material, such as polyethylene or acetal resin.

As can be seen from FIG. 4, screen 11 has a substantially smaller thickness than the thickness of the rest of female portion 10.

In buckle 1, there are strap attachment bars 19, 21 and 22 on the female and male portions, respectively, to attach buckle 1 to a variety of straps.

Buckle 1 is a typical side-release type buckle, with male portion 20 having two release tabs 25 that snap into two locking slots 18 on female portion 10 to lock male portion 20 to female portion 10. Pressing release tabs 25 causes male portion 20 to be ejected from female portion 10. Alternatively a different type of buckle could have a screen portion, such as a single-piece buckle, or a center push buckle. In buckle 10, screen 11 is disposed on both the top and bottom faces of female portion 10. However, screen 11 could also be located on a single face as well.

Accordingly, while only a single embodiment of the present invention have been shown and described, it is obvious that many changes and modifications may be made thereunto without departing from the spirit and scope of the invention.

What is claimed is:

1. A buckle comprising:

a male portion; and a female portion having a top face, a bottom face and a cavity for accepting the male portion, wherein the male portion is adapted to snap into the female portion to lock the two portions of the buckle together; and wherein at least part of at least one face of the female portion is formed from a screen made of the same material as the rest of the female portion and integrally molded with the female portion and wherein the screen is surrounded by a rib having a thickness greater than the thickness of the face containing the screen.

2. The buckle according to claim 1, further comprising a rib disposed along an underside of said at least one face, sad rib extending across the screen to support the part of the buckle containing the screen.

3. The buckle according to claim 2, wherein there are two ribs disposed on an underside of each of the top and bottom faces, said ribs facing each other and extending in a longitudinal direction, and acting as a guide for the male portion when the male portion is inserted into the female portion.

4. The buckle according to claim 1, further comprising at least one strap attachment bar connected to at least one of the male portion and female portion.

5. The buckle according to claim 1, wherein the screen comprises a plurality of crossed bars, defining a set of substantially uniformly spaced holes between the bars.

6. The buckle according to claim 1, wherein the buckle is a side-release type buckle, with the male portion having two release tabs that snap into two locking slots on the female portion to lock the male portion to the female portion, and wherein pressing the release tabs causes the male portion to be ejected from the female portion.

7. The buckle according to claim 1, wherein both the top and bottom faces have a screen.

* * * * *